US005725177A

United States Patent [19]

Bartelmuss et al.

[11] Patent Number: 5,725,177

[45] Date of Patent: Mar. 10, 1998

[54] PAPER WEB WINDING SYSTEM WITH A TEAR STRIP FOR SEVERING THE PAPER WEB

[76] Inventors: Klaus Bartelmuss; Heinz Bartelmuss, both of A-8833, Teufenbach 63, Austria

[21] Appl. No.: 544,072

[22] Filed: Oct. 17, 1995

[30] Foreign Application Priority Data

Oct. 17, 1994 [AT] Austria ..... A 1960/94

[51] Int. Cl.[6] ..... B65H 35/08

[52] U.S. Cl. ..... 242/526.2

[58] Field of Search ..... 242/526.2

[56] References Cited

U.S. PATENT DOCUMENTS

| | | | |
|---|---|---|---|
| 4,659,029 | 4/1987 | Rodriguez | 242/526.2 |
| 4,964,584 | 10/1990 | Taipale et al. | 242/526.2 |
| 5,046,675 | 9/1991 | Rodriguez | 242/526.2 |
| 5,467,937 | 11/1995 | Rodriguez et al. | 242/526.2 |

FOREIGN PATENT DOCUMENTS

| | | | |
|---|---|---|---|
| 4209153 | 7/1992 | Japan | 242/526.2 |

*Primary Examiner*—Daniel P. Stodola
*Assistant Examiner*—William A. Rivera
*Attorney, Agent, or Firm*—Herbert L. Lerner; Laurence A. Greenberg; Werner H. Stemer

[57] ABSTRACT

A paper web which is being wound on a first drum is severed and the winding of the paper web on a second, empty drum is simultaneously initiated. The paper web is severed with a cord, such as a tear strip or the like, whose free end can be moved from the one side of the paper web to its other side. The free end of the tear strip is moved along a guide rail located below the paper web and aligned transversely to it. In the process, a carriage is guided along the guide rail, which is equipped with a holding device for the tear strip. The tear strip is then fastened on the empty drum, whereupon it is spirally wound thereon. The paper web is thus severed and transferred to the empty drum.

14 Claims, 8 Drawing Sheets

PAPER WEB WINDING SYSTEM WITH A TEAR STRIP FOR SEVERING THE PAPER WEB

BACKGROUND OF THE INVENTION

Field of the Invention

The present invention relates to a device for severing a paper web wound on a drum, and for initiating the winding of this paper web on a second, empty drum, wherein severing of the paper web is accomplished by means of a cord or the like, whose free end can be moved from the one side of the paper web to its other side by means of a conveying device along a guide rail located below the paper web and aligned transversely to it, and can be fastened on the empty drum, whereupon it is spirally wound thereon, by means of which the paper web is severed and transferred to the empty drum.

A device of this type is known from European Patent Publication EU 106 659 B1. In this case a conveying device for a tear strip made of paper strings is located on one side of the paper web and can be pulled off a supply drum. A guide rail is disposed below the paper web extending transversely to the paper web from one side to the other side and is embodied with a conduit, open at the top and undercut, for receiving the tear strip. The free end of the tear strip is moved by means of the conveying device from the one side of the paper web toward its other side. A device is provided on the other side of the paper web by means of which the free end of the tear strip is moved toward the empty drum on which it is fastened by means of an adhesive coating. Since the conduit provided in the guide rail is open at the top, as a result the tear strip is pulled upward out of the guide rail and is spirally wound on the empty drum, because of which the paper web is also severed along a spiral line and the adjoining paper web is wound on the empty drum.

However, that prior art device has a number of disadvantages. On the one hand, the tear strip must have the required stiffness in order to be pushed by means of the conveying device along the conduit located in the guide rail from one side of the paper web to its other side. On the other hand, because the conduit provided in the guide rail must be matched to the width of the paper web, there is a requirement either to provide different guide rails for tear strips of different widths, which increases the production outlay, or the requirement to always employ tear strips of the same width, regardless of the actual technical conditions, namely the different widths and the different thicknesses of the paper webs.

Furthermore, in that prior art device the tear strip is torn upward out of the undercut conduit during the severing process, because of which it can be weakened, which must be taken into consideration in the determination of its size. Also, remnants of the tear strip can remain in the conduit, because of which the conveyance of the tear strip through the conduit in the course of the next severing operation is hampered. Accordingly, there is the requirement in connection with the prior art device of periodically cleaning the conduit for the guidance of the tear strip in order to prevent operational malfunctions caused by obstructions.

SUMMARY OF THE INVENTION

It is therefore the object of the present invention to provide a device by means of which the disadvantages connected with the known device can be avoided. This is attained in accordance with the invention in that a carriage is guided along the guide rail, which is equipped with a holding device for the tear strip or the like, because of which its free end can be conveyed from the one side of the paper web to its other side.

Preferably a support for two clamping jaws is disposed on the carriage, wherein one of the clamping jaws is pivotably seated on the support. In the process, the second clamping jaw in particular can be pivoted on the support in relation to the first clamping jaw against the action of a restoring spring.

In accordance with a preferred embodiment, the carriage is guided inside the guide rail, wherein the guide rail is provided with a slot through which a support for the holding device extends. Furthermore, the guide rail is preferably enclosed in a housing below the paper web, in whose interior chamber the guide rail is located. In this case the housing is closed off by means of a pivotable flap on the side facing the empty drum.

In accordance with further preferred embodiments, the slot of the guide rail through which the support of the holding device extends is located on a first side, the holding device is located approximately below the guide rail, wherein it can be opened in the direction of the other side, and the flap which can be opened is located on the other side of the housing.

The guide rail is preferably fastened on a support rail extending below the paper web. Furthermore, the carriage is preferably movable by means of a cable or the like along the guide rail. In case the cable is endless, one strand can be guided inside the guide rail and the other strand inside the support rail.

In accordance with further preferred features, the holding device is formed by two clamping jaws, which are embodied in the form of rollers rotatably seated on the support, wherein one of them is equipped with a return stop and furthermore one of them can be driven. For this purpose one of these two rollers can be embodied with a conical gear wheel which can be connected with a rotary drive.

Clamps, embodied with adjustable, in particular resilient, flaps, are preferably provided in the area of the guide rail where it is not enclosed by the housing.

The subject of the invention will be explained in detail below by means of an exemplary embodiment represented in the drawings.

DESCRIPTION OF THE PREFERRED EMBODIMENTS

Figure 1:
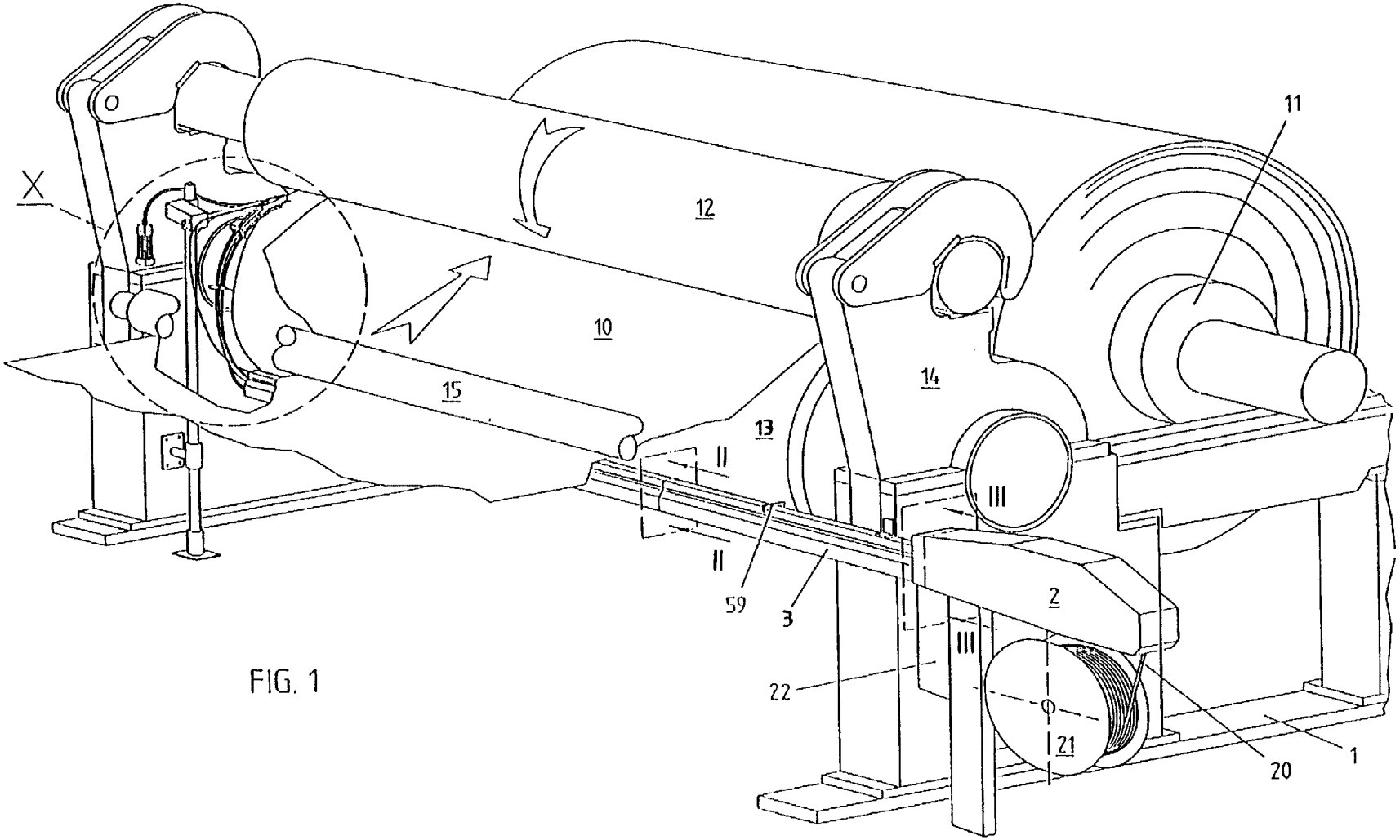
FIG. 1 is an axonometric view of a device for severing a paper web.

A device in accordance with the invention is employed in an installation for winding up a paper web and is provided at the end of a paper producing installation. This device has a support frame 1 for a first drum 11, which rests against a drive drum 13, and to which the paper web 10, arriving from the paper producing installation, is supplied via a guide roller 15 and on which it is wound. Furthermore, a pivotable support device 14 for a second drum 12 is provided, on which the paper web 10 is wound as soon as the first drum 11 has attained the desired coil thickness. The paper web 10 must be severed in order to be transferred to the second drum 12 during the process of unwinding from the first drum 11.

A tear strip 20 is used for this purpose, whose free end is conveyed by means of an apparatus 2, located on one side of the paper web 10, from this side of the paper web 10 to its other side. As soon as the operation for severing the paper web 10 is to be initiated, the tear strip 20 is fastened, by means of an adhesive coating thereon, on the empty drum 12, because of which it is spirally wound thereon. In the process the tear strip 20 is ripped out of the conveying device 3 as far as a bow 59. Because of this the paper web 10 is also spirally severed. The front ripping edge of the paper web 10 is simultaneously brought into contact with the empty drum 12, wherein as a result the paper web 10 is wound onto the second drum 12. Subsequently the first drum 11, which has attained the desired coil diameter, is removed and the second drum is disposed in its place and is kept in rotation by applying the drive drum 13 to it, and a further empty drum is inserted into the support device 14.

It is accordingly possible by means of an installation of this type to wind the paper web 10, which is supplied by the paper producing installation at a speed of 25 m/sec, for example, continuously on drums. As soon as the first drum 11 has attained the predetermined coil diameter, the paper web 10 is severed, winding is switched to the empty second drum 12 and the full drum is transported away.

Figure 2:
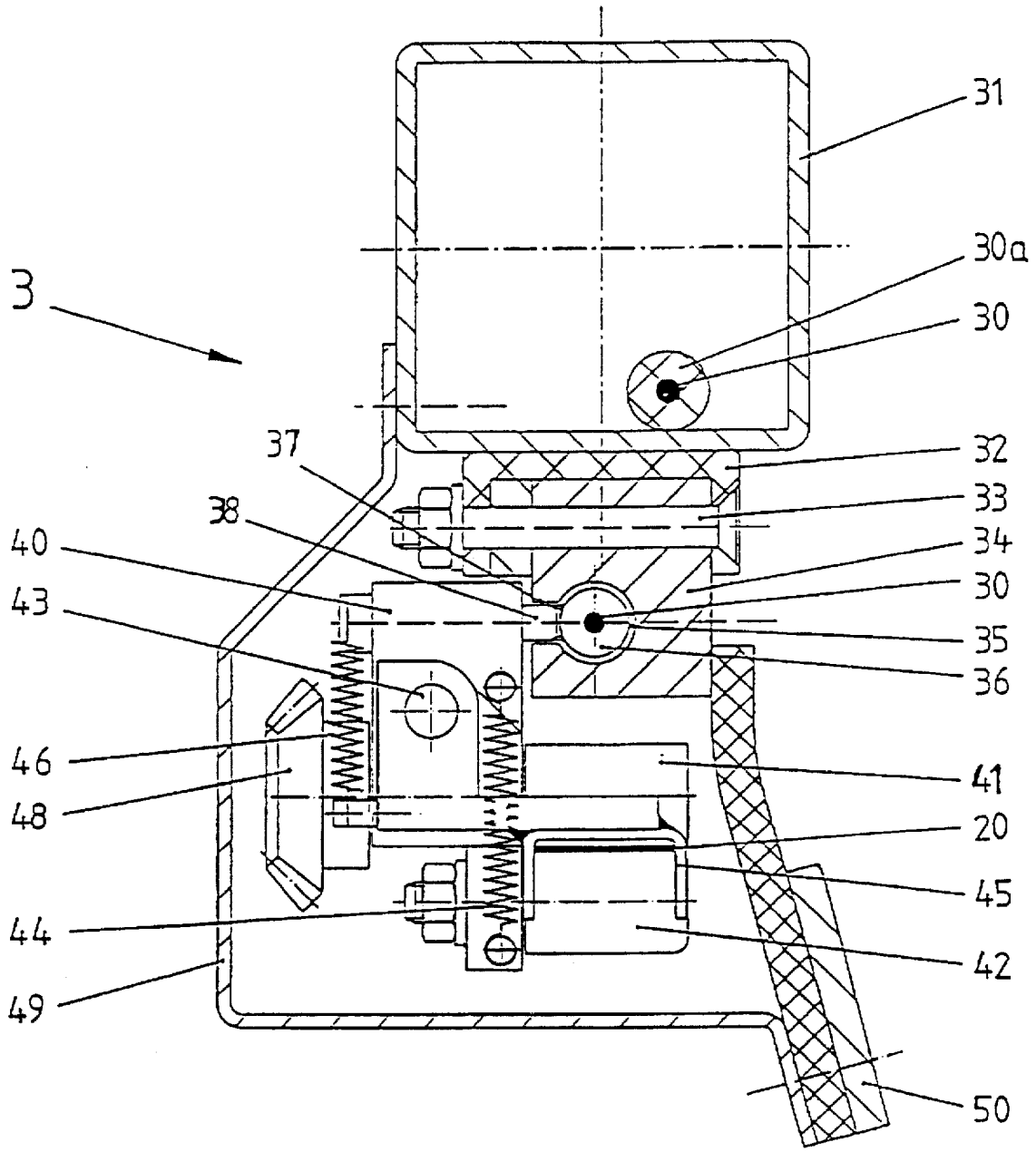
FIG. 2 is a sectional view in the plane II—II of FIG. 1.

The tear strip 20 is pulled off a supply drum 21 by means of the apparatus 2 and is fed to the conveying device 3, by means of which the free end of the tear strip 20 is moved from the one side of the paper web 10 to its other side. In addition, an adhesive is applied to the free end of the tear strip 10 in the apparatus 2, which is used to fasten the tear strip 20 on the empty drum 12 in order to be able to initiate the severing operation. A housing 22 is located on the apparatus 2, in which the loops of the tear strip 20, necessary for the severing operation, are formed. In addition, a braking device and a severing device for the tear strip 20 are contained in the apparatus 2. The conveying device 3 adjoins the apparatus 2 and will be explained below by means of FIG. 2.

The conveying device 3 has a support rail 31, on which a guide rail 34 is releasably fastened by means of a downward extending U-shaped strip 32 by bolts 33. The guide rail 34 is embodied with a cylindrical conduit 35 in which a cylindrical carriage 36 is guided. Two pegs 37 project laterally outward from the carriage 36 and extend through a slot 38 located in the guide rail 34, and on which a support 40 for two clamping jaws 41 and 42 is fastened. The upper clamping jaw 41 is rigidly connected with the support 40. However, the lower clamping jaw 42 on the support 40 is seated, pivotable around a bolt 43 against the action of a restoring spring 44. In the movement direction of the tear strip 20, a bow 45 is located in front of the two clamping jaws 41 and 42, in which the tear strip 20 is guided, and is upwardly pivotable around the bolt 43 against the action of a spring 46.

The carriage 36 can be moved in the conduit 35 of the guide rail 34 by means of an endless traction cable 30. In this case the one strand of the traction cable 30 is guided in the manner of a Bowden cable in the conduit 35 of the guide rail 34 and the other strand in a hose **30*a* disposed in the support rail 31. The two clamping jaws 41 and 42 are formed by rotatable rollers One of the two rollers, in particular the upper roller 41 is embodied with a return stop. The upper roller 41 is furthermore coupled by means of a shaft with a conical gear wheel 48** for propulsion.

A housing 49 is fastened on the support rail 31 and encloses the guide rail 34 and the support 40, and is closed off by means of a flap 50 made of a resiliently deformable material on the side facing the drums 11 and 12.

In the initial position the carriage 34, and therefore the support 40 with the clamping jaws 41 and 42, is located on the side of the device on which the apparatus 2 is located. A control cylinder 23 associated with the support 40 is provided in this area, represented in FIGS. **3*a* and 3*b*, by means of whose piston 24 the lower roller 42 can be downwardly pivoted against the action of the spring 44. When this roller 42 is pivoted away, the tear strip 20 can be conveyed between the two rollers 41 and 42, used as clamping jaws, and in the process its free end which is provided with an adhesive coating is outside of the two clamping jaws 41 and 42** so that the adhesive coating is not damaged.

Figure 4:
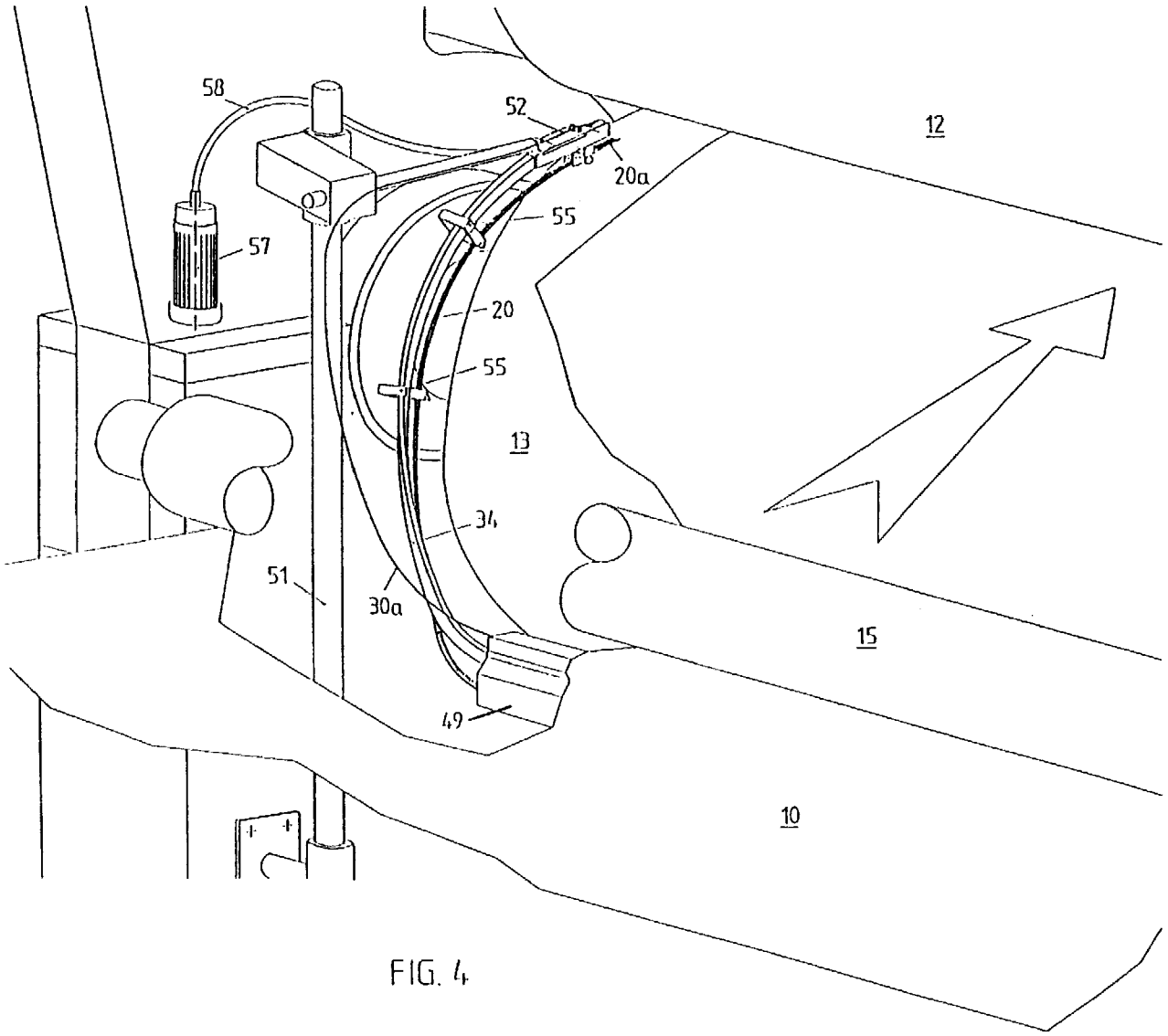
FIG. 4 is an enlarged view of a detail X in FIG. 1.

As can be seen in FIG. 4, on the other side of the paper web 10 the guide rail 34 is embodied with a spatial curvature, wherein it terminates in a support device 52 provided on a frame 51. The tear strip 20 grasped between the two clamping jaws 41 and 42 is held by means of this support device 52 in such a way that its free end **20*a* is oriented in the direction toward the empty drum 12. Since the housing 49 terminates in the area of the left edge of the paper web 10 and the tear strip 20 requires guidance in the area of the curvature of the guide rail 34, several clamps 55 are provided for this, which enclose the tear strip 20. A drive element 57 is furthermore associated with the support device 52 which is brought via a flexible shaft 58 to a drive wheel 56, which can be coupled with the conical gear wheel 48**.

Figure 5:
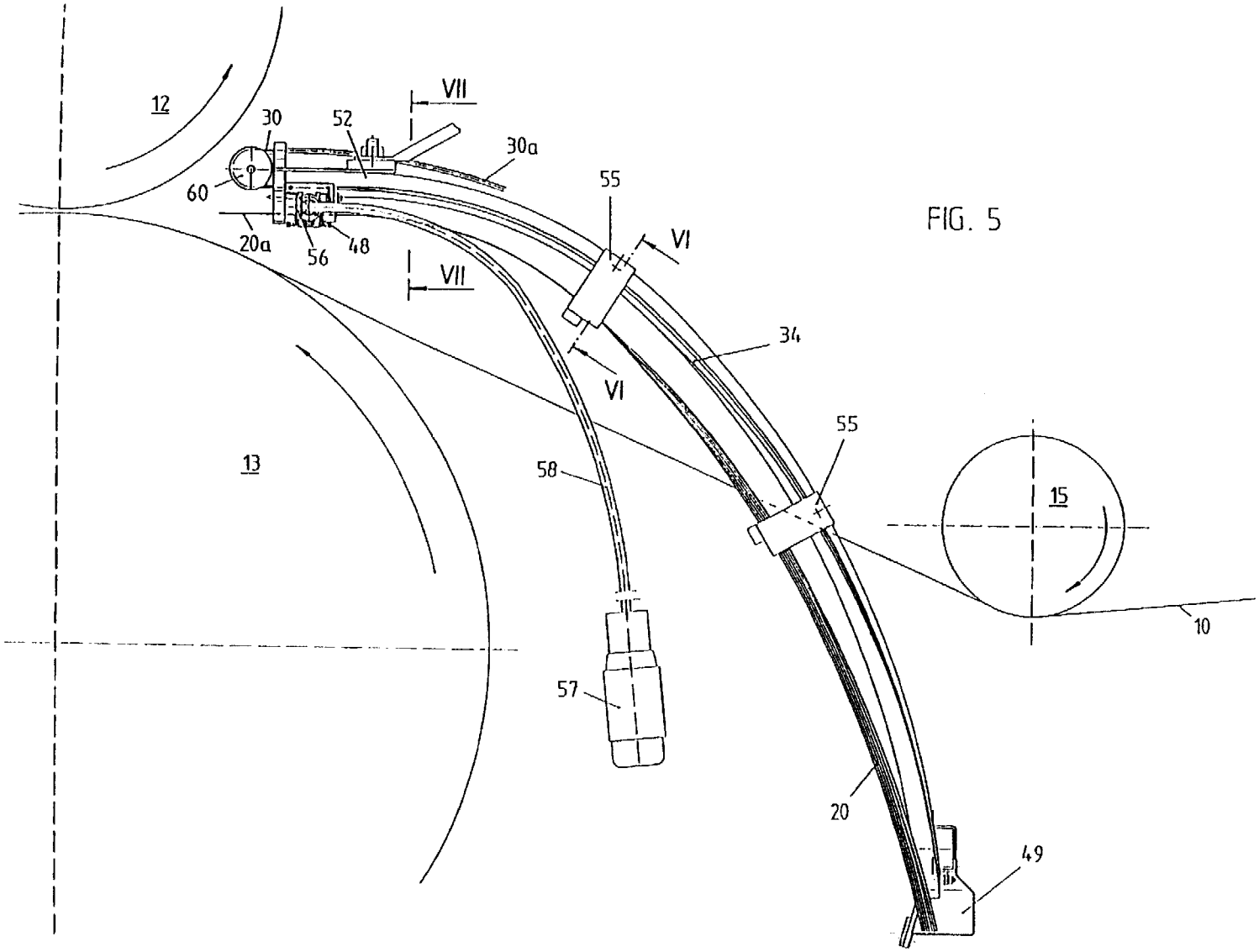
FIG. 5 is a further enlarged view of the detail X.

The course of the guide rail 34 and of the tear strip 20 in the direction of the shafts of the drums 12 and 13 is represented in FIG. 5. As can be seen from this, the guide rail 34 extends upward in a curve and consequently in a curvature outside of the drive drum 13. The tear strip 20 which is conveyed along the guide rail 34 by means of the carriage 36 follows this course and is guided inside the clamps 55 in the process. A reversing roller 60 for the conveying cable 30 is also seated on the support device 52.

Figure 6:
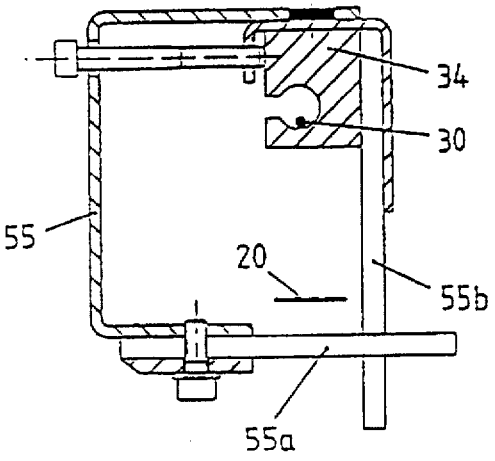
FIG. 6 is a sectional view along the line VI—VI in FIG. 5 on an enlarged scale.

As can be seen from FIG. 6, the clamps 55 fastened on the guide rail 34 are embodied with two resiliently deformable lateral flaps **55*a* and 55*b***.

Figure 7:
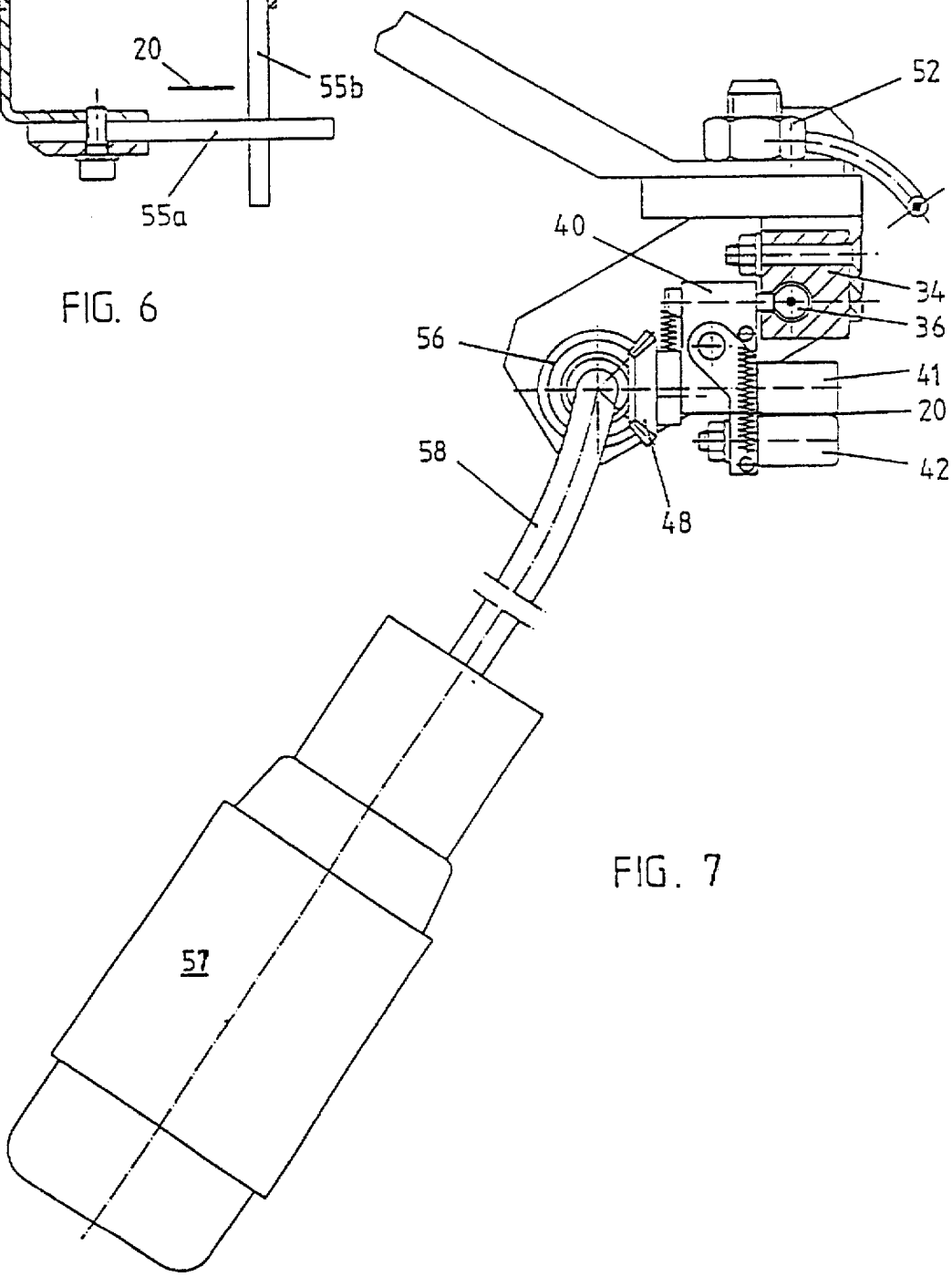
FIG. 7 is a sectional view along the line VII—VII in FIG. 5 on an enlarged scale.
Figure 8B:
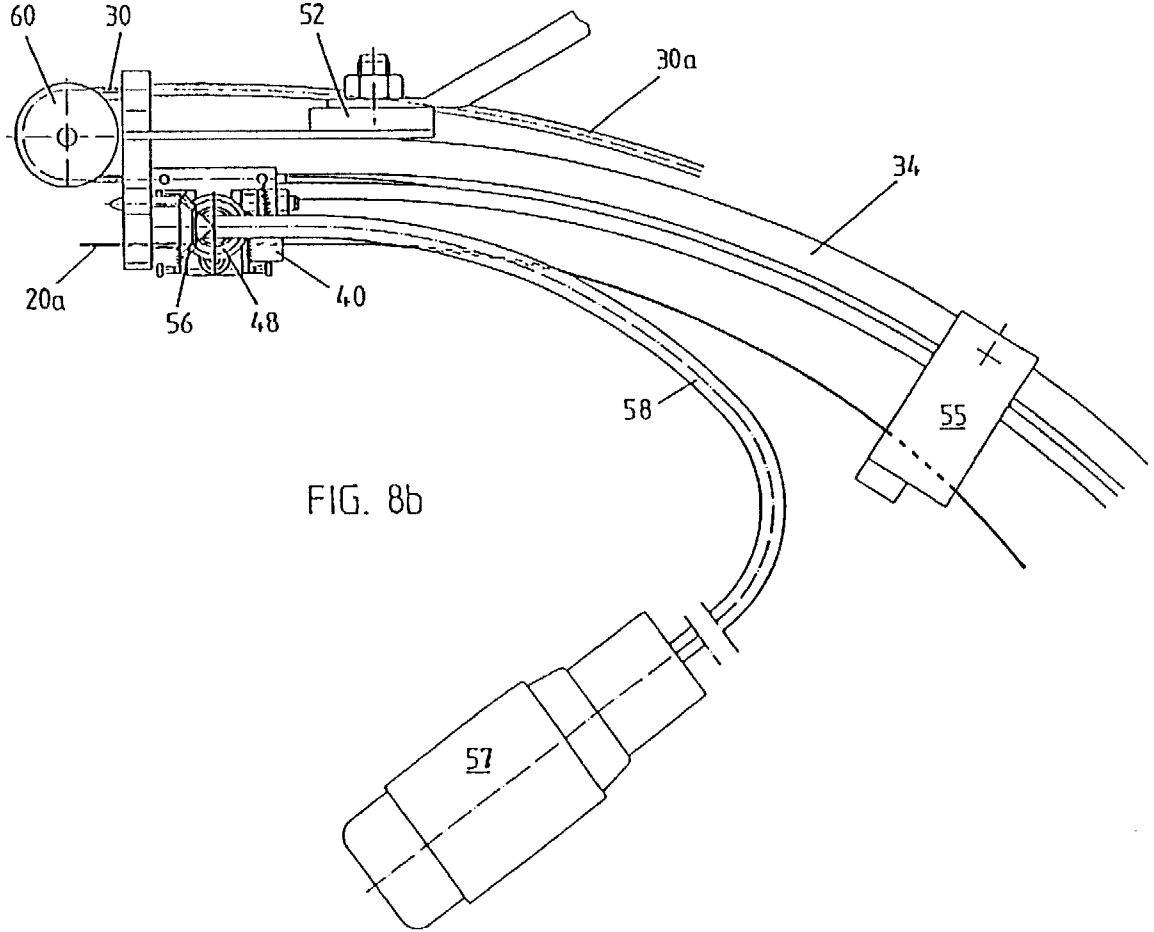
FIGS. 8*a* and 8*b* show a further detail in a sectional and a lateral view.
Figure 8A:
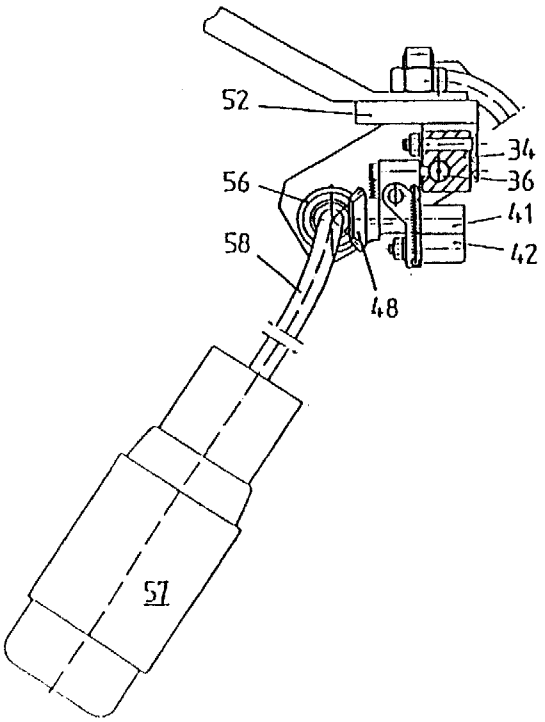

As can be seen from FIG. 7 in particular, the conical gear wheel comes into engagement with the drive wheel 56 at the end of the guide rail 34. All these details are also illustrated in FIGS. **8*a* and 8*b***.

Figure 3A:
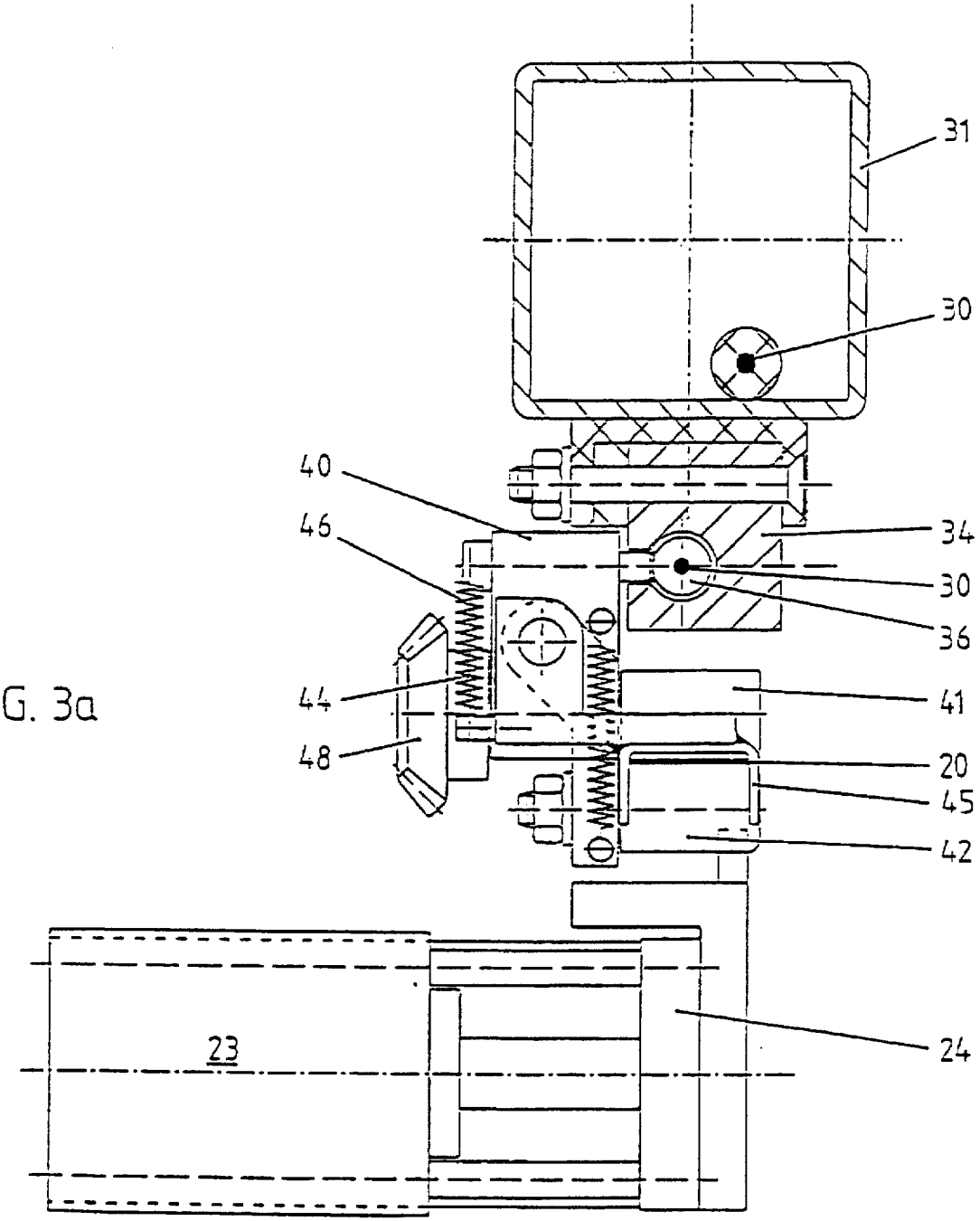
FIGS. 3*a* and 3*b* are sectional views in the plane III—III of FIG. 1 in two different operational positions.
Figure 3B:
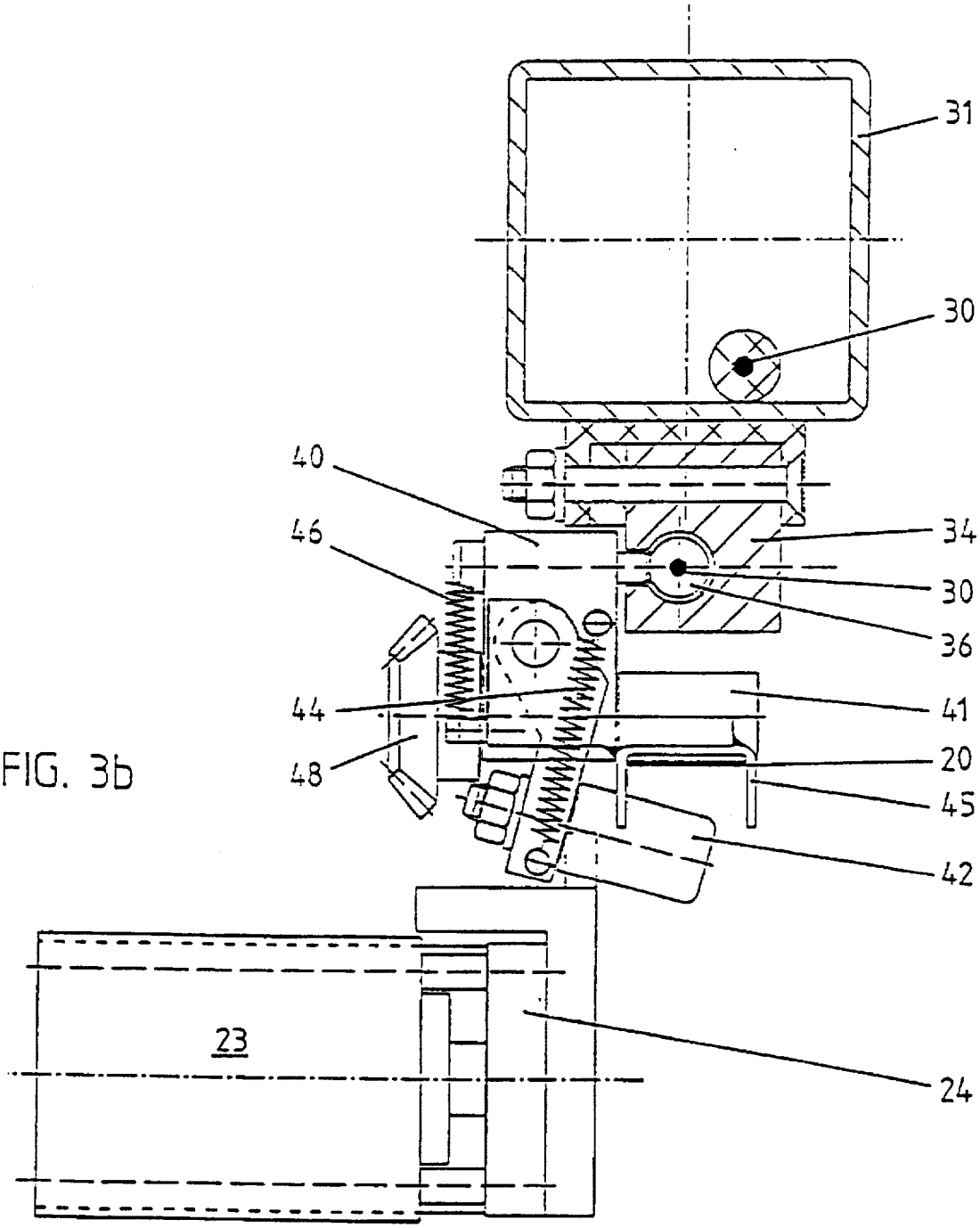

The function of this device is as follows: A tear strip 20 is pulled off the supply roll 21 by means of the apparatus 2 and the top of its free front end **20*a* is coated with an adhesive in the apparatus 2. Following this, the free front end 20*a* of the tear strip 20 is passed between the two clamping jaws 41 and 42, which are in the open position in the first end position of the carriage 36 or of the support 40, represented in FIG. 3*b*. Subsequently the two clamping jaws 41 and 42 are brought into their closed position by means of the control cylinder 23, because of which the tear strip 20 is gripped behind the adhesive layer 20*a*, and the carriage 36 is conveyed from the one side of the paper web 10 to its other side by means of the cable 30, in the course of which the tear strip 20 is pulled along. In the process the tear strip 20 is in a slightly tightened state inside the housing 49. The carriage 36 is moved further as far as the support device 52 and pulls the tear strip 20 along. At this place the free end 20***a* of the tear strip 20 is oriented in the direction toward the empty drum 12 and the adhesive layer is on its top.

As soon as the paper web 10 is to be severed, the empty drum 12 is brought to the rotational speed of the first drum 11 by means of a drive associated with it. After this the support device 14 is pivoted clockwise, because of which the drum 12 comes into contact with the drive drum 13 and is kept in rotation by it. As soon as the free end 20*a* of the tear strip 20 is now moved toward the drum 12 by means of the drive element 57 and via the conical gear wheel 48, it adheres to it because of its adhesive coating and is pulled along by it. Because of this the tear strip 20 is ripped out of the two clamping jaws 41 and 42 and in the process the bow 45 is pivoted upward against the action of the spring 46 and releases the tear strip 20. Furthermore, the tear strip 20 is also ripped out of the clamps 55, whose resilient flaps 55*a* and 55*b* open, as well as out of the housing 49, whose resilient flap 50 also opens, as far as the bow 59 and it is spirally wound on the drum 12. In the process the previously wound loops are employed. Finally, the tear strip 20 is severed. The movement of the tear strip 20 is braked by the resilient flaps 55*a* and 55*b* of the clamps 55, by the resilient flap 50 of the housing 49 and by the band brake located in the apparatus 2. Shock-like movements of the tear strip 20 are prevented by this.

Along with the spiral winding of the tear strip 20 on the drum 12, the paper web 10 is also spirally severed and its front ear edge is brought to rest on the drum 12, because of which the further paper web 10 is wound on the drum 12. Following this, the full drum 11 is removed, the empty drum 12 is put in its place, the support device 14 is pivoted back and an empty drum is inserted in it. Furthermore, the carriage 36 is returned into its initial position and, after having been coated with adhesive, the front end of the tear strip 20 is again moved to the other side of the paper web by means of the conveying device. In this way the device is prepared for a fresh severing operation and the start of the winding operation on an empty drum.

Since by means of such a device it is possible to move all types of tear elements from one side of the paper web to its other side, the tear strips can be matched to the width of the paper web or the strength of the paper. Only the tensile strength of the tear element, required by the paper web, is important. It is also possible to employ tear cords.

We claim:

1. A device for severing a paper web wound on a first drum, and for initiating the winding of the paper web on a second, empty drum, comprising:

a guide rail extending substantially transversely to a traveling paper web, a carriage movably guided along said guide rail, and a holding device disposed in said carriage;

a tear strip for severing the paper web, a supply of said tear strip mounted on one side of said paper web, said tear strip having an end adapted to be held by said holding device in said carriage and being movable by said carriage along said guide rail from the one side of the paper web to another side thereof; and wherein, prior to severing the paper web, said tear strip is moved to extend along said guide rail from the one side of the paper web to the other side thereof and wherein, for severing the paper web, said tear strip is wound on the second drum starting from the other side of the paper web and to the one side thereof, such that the paper web is severed and transferred to the second drum.

2. The device according to claim 1, wherein said holding device includes first and second clamping jaws and a support for said first and second clamping jaws, said support being disposed on said carriage, and one of said first and second clamping jaws being pivotally seated on said support.

3. The device according to claim 2, which further comprises a restoring spring acting against said second clamping jaw, said second clamping jaw being pivotable on said support relative to said first clamping jaw against the action of said restoring spring.

4. The device according to claim 1, which further comprises a support supporting said holding device on said carriage, and wherein said guide rail is formed with a slot, said carriage is guided inside said guide rail, and said support for said holding device projects outwardly through said slot.

5. The device according to claim 4, which further comprises a housing enclosing said guide rail, and a pivotable flap closing said housing on a side thereof facing the second drum, and wherein said slot of said guide rail is formed on a first side, the holding device being located approximately below said guide rail, wherein said holding device is adapted to be opened in the direction opposite said first side, and said pivotable flap which is adapted to be opened is located opposite said first side of the housing.

6. The device according to claim 1, which further comprises a housing enclosing said guide rail, said housing being disposed below the paper web and defining an interior chamber, and including a support for said holding device disposed in said interior chamber.

7. The device according to claim 6, which further comprises a pivotable flap closing said housing on a side thereof facing the second drum.

8. The device according to claim 1, which further comprises a support rail extending below the paper web, said guide rail being fastened on said support rail.

9. The device according to claim 1, which further comprises a cable drive for moving said carriage along said guide rail.

10. The device according to claim 9, wherein said cable drive includes an endless cable defining a first strand guided inside said guide rail and a second strand guided inside said support rail.

11. The device according to claim 1, wherein said holding device comprises a support and two clamping jaws in the form of rollers rotatably seated on said support, one of said rollers including a return stop and the other of said rollers being a driven roller.

12. The device according to claim 11, which further comprises a rotary drive connected to said driven roller, said driven roller being embodied with a conical gear wheel connectible with said rotary drive.

13. The device according to claim 1, which further comprises a housing enclosing said guide rail, and clamps with adjustable flaps disposed in regions of said guide rail where said guide rail is not enclosed by said housing.

14. The device according to claim 13, wherein said adjustable flaps are resilient flaps.

* * * * *